US005156562A

United States Patent [19]

Pearson et al.

[11] Patent Number: 5,156,562

[45] Date of Patent: Oct. 20, 1992

[54] SUBMERGED ARTICLE MARKER AND RETRIEVER

[76] Inventors: Johnny M. Pearson, Rte. 1, Box 43, Seminole, Okla. 74868; Terry W. Smith, 1717 N. May, Guymon, Okla. 73942

[21] Appl. No.: 732,043

[22] Filed: Jul. 18, 1991

[51] Int. Cl.[5] ..... B63B 22/10

[52] U.S. Cl. ..... 441/8; 43/25

[58] Field of Search ..... 441/1, 7, 8, 11-20; 43/25

[56] References Cited

U.S. PATENT DOCUMENTS

| | | | |
|---|---|---|---|
| 2,190,531 | 2/1940 | Kaboskey et al. | 441/8 |
| 2,198,755 | 4/1940 | Berndt | 441/8 |
| 2,479,021 | 8/1949 | Perkins | 441/8 |
| 2,479,098 | 8/1949 | Cardinal | 441/8 |
| 2,528,799 | 11/1950 | Strong | 441/8 |
| 2,531,586 | 11/1950 | Ramsey | 441/8 |
| 2,539,548 | 1/1951 | Norris et al. | 441/8 |
| 2,588,637 | 3/1952 | Krantz | 441/8 |
| 2,675,568 | 4/1954 | King | 441/8 |
| 2,723,404 | 11/1955 | Krantz | 441/8 |
| 2,783,731 | 3/1957 | Wilhelm | 441/8 |
| 2,785,420 | 3/1957 | Kanaley | 441/8 |
| 2,791,785 | 5/1957 | Metts | 441/8 |
| 2,806,231 | 9/1957 | Hofmeister | 441/8 |
| 2,821,725 | 2/1958 | Harper | |
| 2,941,217 | 6/1960 | Hartl | 441/8 |
| 2,968,819 | 1/1961 | Jenson | 441/8 |
| 3,049,733 | 8/1962 | Mennenga | 441/8 |
| 3,313,268 | 4/1967 | Reiffel | 441/8 |
| 3,982,294 | 9/1976 | Hicken | 441/8 |
| 4,126,907 | 11/1978 | Fish | 441/8 |
| 4,290,159 | 9/1981 | McLennan et al. | 43/25 |
| 4,583,314 | 4/1986 | Kirkland | 43/25 |
| 4,619,066 | 10/1986 | Kirkland et al. | 43/25 |
| 4,713,031 | 12/1987 | Fuller | 441/8 |
| 4,766,690 | 8/1988 | Troha | 43/25 |

*Primary Examiner*—Jesûs D. Sotelo

*Attorney, Agent, or Firm*—James T. Robinson

[57] ABSTRACT

A marker-retriever mountable on a fishing rod, hand tool, or other article to be used near water, for marking and retrieving the submerged article should the article be dropped into water; the marker-retriever including, generally, a housing comprising a fixed housing member, a releasable housing member, and a wrapper partially enclosing the housing members to maintain cooperation therebetween, attaching means for securing the housing to the article, a buoy disposed within the housing, release means for releasing the buoy from the housing when the article is submerged, and a line connecting the buoy to the attaching means.

1 Claim, 2 Drawing Sheets

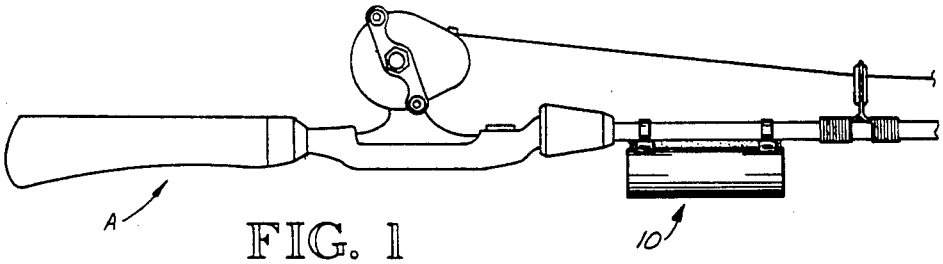
FIG. 1
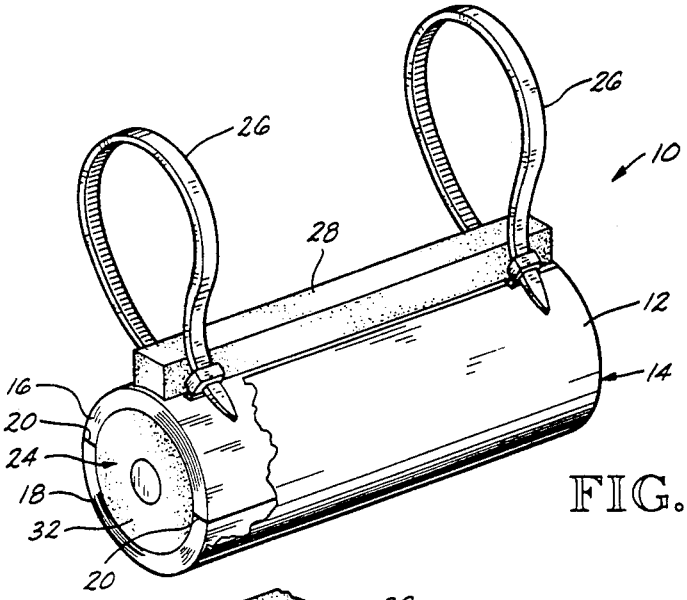
FIG. 2
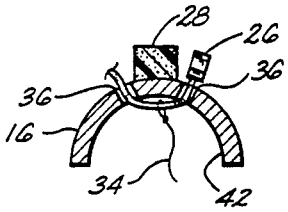
FIG. 3A
FIG. 3
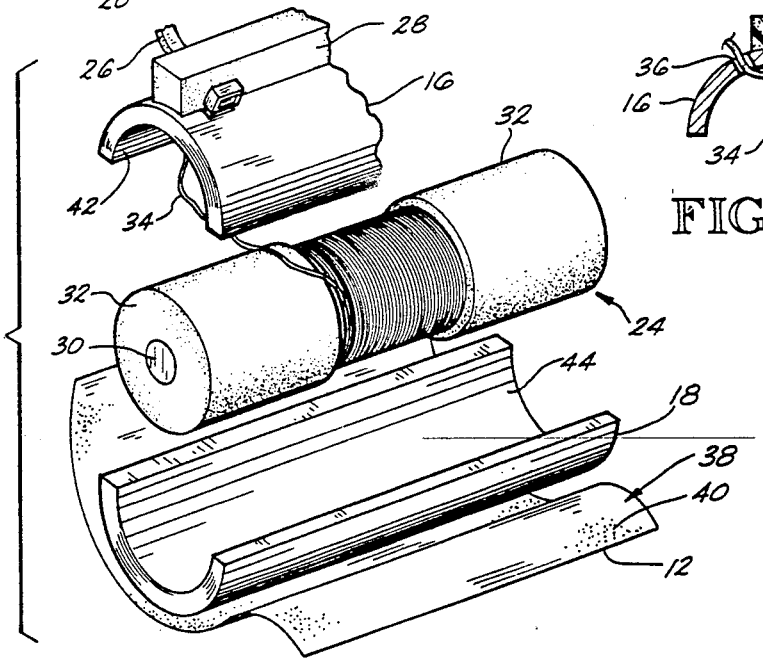

SUBMERGED ARTICLE MARKER AND RETRIEVER

BACKGROUND OF THE INVENTION

1. Field of the Invention

This invention relates to a marking and retrieving device for attachment to articles used near water and more particularly, but not by way of limitation, to a marking and retrieving device which marks the location of submerged article and provides a line for retrieval of the article.

2. Description of the Prior Art

Markers and retrieving devices releasable upon immersion in water have previously been proposed. A common type of marking device includes a solid material which dissolves upon immersion to release a marker.

The devices heretofore proposed have not proven wholly satisfactory. This may be due in part to the complex mechanical nature of the release mechanisms and also to the sensitivity of the water soluble material to incidental and natural moisture so that the mechanism may release prior to immersion.

The simple and uncomplicated structure of the present invention protects against premature release of the marker/retriever while providing a quick response to immersion.

SUMMARY OF THE INVENTION

According to the present invention a submerged article marker and retriever is provided which is attached to an article used near water and releases a marker upon immersion. A buoy and a suitable length of line are disposed within a housing formed by the cooperation of two water-absorbent housing members. A wrapper partially enclosing and bonded to the housing members by a water-soluble adhesive maintains cooperation of the housing members until the invention is immersed. When the article to which the invention is attached becomes submerged the water-soluble adhesive dissolves, the wrapper unfurls and the housing members separate to release the marker buoy. The marker buoy, connected to the submerged article by a line of sufficient length, moves to the surface to provide both a marker and a means of retrieving the submerged article.

An object of the present invention is to provide a marker-retriever which is readily attachable to an article used near water, and which, in case the article falls into deep water, will send up a float to the water's surface to mark the location of the submerged article, the float being attached to the submerged article by a line with which the article can be immediately retrieved.

Another object of the invention, while achieving the before stated object, is to provide a marker-retriever which is released quickly upon immersion in water.

Another object of the invention, while achieving the before stated objects is to provide a marker-retriever which is simple in design, inexpensive to manufacture, rugged in construction, easy to use, and efficient in operation.

Another object of the invention, while achieving the before stated objects, is to provide a marker-retriever which is protected from premature activation in the absence of immersion.

Another object of the invention, while achieving the before stated objects, is to provide a marker-retriever which does not introduce environmentally harmful materials into lakes and other bodies of water.

Another object of the invention, while achieving the before stated objects, is to provide a marker-retriever which may be attached easily to an article to be used near water.

Other objects, features and advantages of the present invention will become apparent from the following detailed description when read in conjunction with the drawings and appended claims.

BRIEF DESCRIPTION OF THE DRAWINGS

FIG. 1 is a side elevational view of our marker-retriever device in use on a fishing rod.

FIG. 2 is a pictorial view of the marker-retriever device.

FIG. 3 is a fragmentary exploded view of the marker-retriever device as it appears in FIG. 2.

FIG. 3A is a cross-section of the fixed housing member.

DETAILED DESCRIPTION

Figure 4:
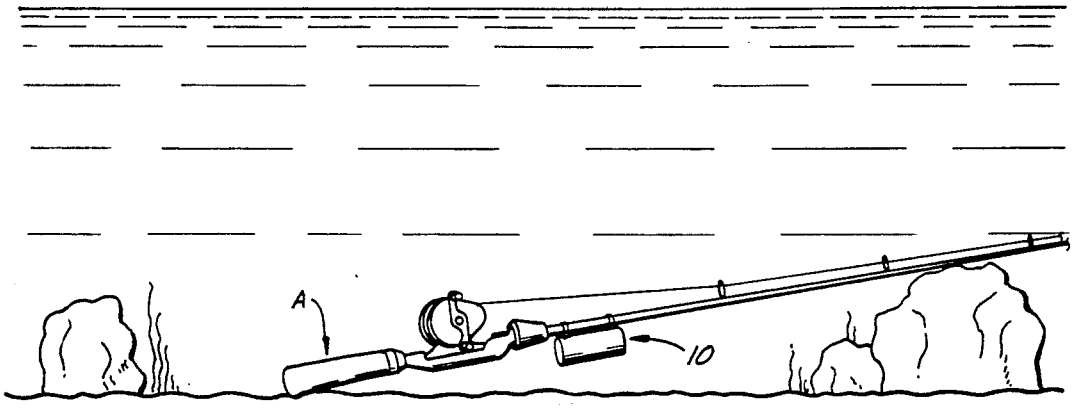
FIG. 4 is a pictorial view of our invention on a submerged fishing rod prior to release.
Figure 6:
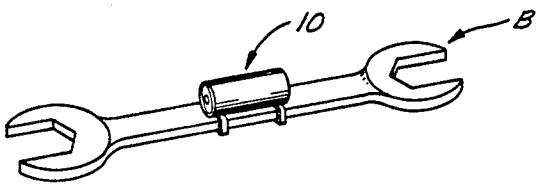
FIG. 6 is a pictorial view of our invention in use on a hand tool.

Referring now to the drawings, and more particularly to FIGS. 1, 4 and 6, a marking and retrieving device 10 of the present invention is shown mounted on an article to be used near water. In FIGS. 1 and 4, the present invention is mounted on a fishing rod A. In FIG. 4, the fishing rod A on which the marking and retrieving device 10 is mounted is submerged in water. In FIG. 6, the marking and retrieving device is shown mounted on a hand tool B.

Referring now to FIG. 2, a marker-retriever device 10 is illustrated. A wrapper 12 partially enclosed a housing 14 formed by the cooperation of a fixed housing member 16 and a releasable housing member 18. While, in the presently preferred embodiment of the invention, the fixed housing member 16 and the releasable housing member 18 are in the form of split collars which abut at seams 20 to form a cylindrical housing 14, it will be clear to those skilled in the art that the housing 14 may be formed from any number of housing members and in any geometrical configuration. The housing 14 defines a cavity 22 (not shown) in which a buoy 24 is disposed.

Still referring to FIG. 2, flexible ties 26 are provided for attaching the housing 14 to an article (not shown) to be used near water. The flexible ties 26 illustrated are of the type commonly used by electricians as wire ties, but it will be clear to those skilled in the art that any flexible fastening device may be used. It will also be clear that a single fastening device may be used to attach the housing 14 to the article.

Still referring to FIG. 2, a compression member 28 attached to the housing 14 provides a snug fit between the housing 14 and the article when the flexible ties 26 are pulled tight. The compression member 28 may consist of any compressible material which can be bonded to the housing 14. It will be understood by those skilled in the art that the present invention will function as herein disclosed in the absence of the compression member 28.

Referring now to FIGS. 3 and 3A, the buoy 24 is formed by a spindle 30 and flotation members 32. The spindle 30 also serves as a spool for a line 34, attached to the spindle 30 and to one of the flexible ties 26, shown in FIG. 3A passing through ports 36 in the fixed housing member 16.

Referring now to FIG. 3, the wrapper 12 has an inner surface 38 supporting a coating of water-soluble adhesive 40. The coating of water-soluble adhesive 40 bonds the wrapper 12 to both the fixed housing member 16 and the releasable housing member 18 to form the housing 14 containing the buoy 24. The flotation members 32 are formed of sufficient size to effectuate a snug fit against the interior surfaces 42, 44 of fixed housing member 16 and releasable housing member 18, respectively.

Figure 5:
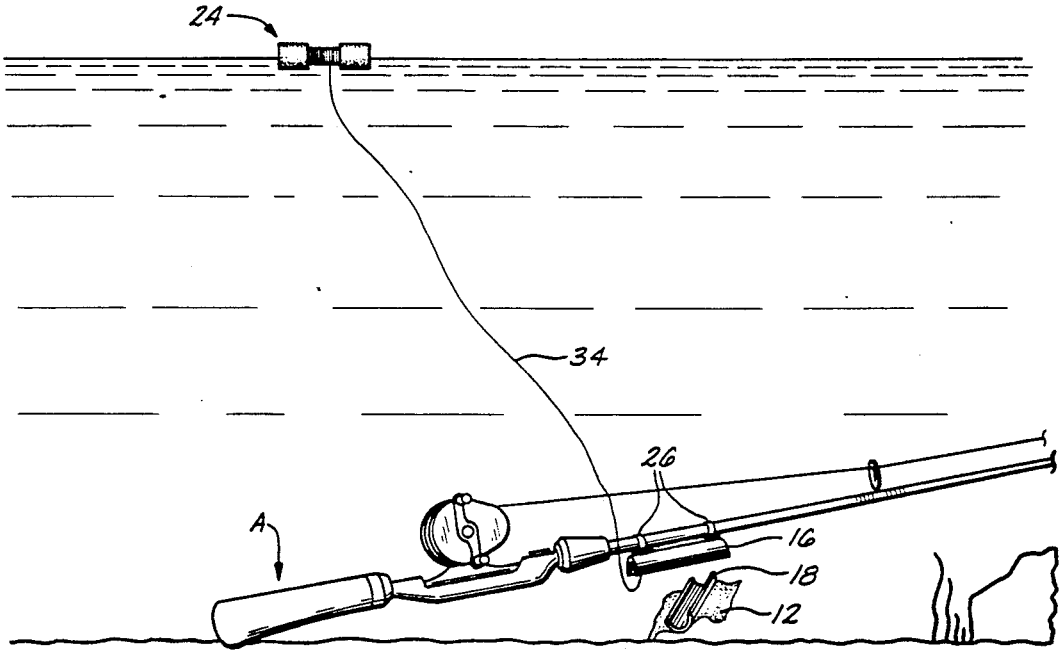
FIG. 5 is a view similar to FIG. 4 but showing our invention in a released position.

Referring now to FIG. 5, the marker-retriever device 10 is depicted after the fishing rod A to which the device 10 is attached has been submerged. The wrapper 12 has separated from the fixed housing member 16 and the releasable housing member 18, permitting the buoy 24 to move to the surface. The line 34 is of a length sufficient to permit the fishing rod A to remain submerged and the buoy 24 to remain on the surface. It will be understood by those skilled in the art that the length of line 34 required may require a larger buoy 24 on which to store the line 34 and, consequently, a larger housing 14 in which the buoy 24 is disposed. In most bodies of water, a length of one hundred-fifty to two hundred feet is adequate.

In the presently preferred embodiment of our invention, the fixed housing member 16 and the releasable housing member 18 are constructed of a biodegradable porous cardboard which absorbs water very quickly. The high absorption rate provides for rapid dissolution of the coating of water-soluble adhesive 40 and a quick release of the buoy 24 upon immersion. The wrapper 12 is constructed of a biodegradable paper which repels water. The water-repellant wrapper 12 prevents release of the buoy 24 on exposure of our invention to incidental and natural moisture, e.g., light rains and water spray experienced during boating. It will be clear to one skilled in the art that the wrapper 12 may be constructed of any flexible material which can be bonded to the fixed housing member 16 and the releasable housing member 18.

Still referring to FIG. 5, retrieval of the fishing rod A will also recover the fixed housing member 16, the ties 26, and the compression gasket 28. The wrapper 12 and the releasable housing member 18 will not be retrieved with the fishing rod A. In the presently preferred embodiment of our invention, the paper wrapper 12 and the releasable housing member 18 are constructed of biodegradable materials to minimize impact on the ecology of the lake or other body of water.

It will be clear that the present invention is well adapted to carry out the objects and attain the ends and advantages mentioned as well as those inherent therein. While a presently preferred embodiment has been described for purposes of this disclosure, numerous changes may be made which will readily suggest themselves to those skilled in the art and which are encompassed in the spirit of the invention disclosed and as defined in the appended claims.

What is claimed is:

1. A device for marking and retrieving an article submerged in a lake or other body of water, comprising:

a housing, comprising;

a fixed housing member;

a releasable housing member cooperating with the fixed housing member to define a cavity; and a wrapper partially enclosing the fixed housing member and the releasable housing member, the wrapper secured to the fixed housing member and the releasable housing member so as to maintain cooperation between the housing members;

attaching means for securing the housing to the article;

a buoy disposed within the housing;

release means for releasing the buoy from the housing when the article is submerged so that the buoy will rise to the surface of the lake or other body of water, said release means comprising a coating of a water-soluble adhesive securing the wrapper to the housing members, so that the wrapper will be released from the housing members when the device is submerged in water and, further, the releasable housing member will separate from the fixed housing member to deploy the buoy; and a line connecting the buoy to the attaching means, the line having a length sufficient to permit the released buoy to reach the surface of the body of water while the article remains submerged.

* * * * *